US011512546B2

(12) United States Patent
Christie et al.

(10) Patent No.: US 11,512,546 B2
(45) Date of Patent: Nov. 29, 2022

(54) COILED TUBING ELECTRONICALLY CONTROLLED MULTILATERAL ACCESS OF EXTENDED REACH WELLS

(71) Applicant: Schlumberger Technology Corporation, Sugar Land, TX (US)

(72) Inventors: Rich Christie, Sugar Land, TX (US); Luis Fernando Silva, Richmond, TX (US); Jordi Juan Segura Dominquez, Sugar Land, TX (US); Mark Callister Oettli, Richmond, TX (US); Afsal Areepetta Mannil, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/755,657

(22) PCT Filed: Oct. 12, 2018

(86) PCT No.: PCT/US2018/055553
§ 371 (c)(1),
(2) Date: Apr. 13, 2020

(87) PCT Pub. No.: WO2019/075290
PCT Pub. Date: Apr. 18, 2019

(65) Prior Publication Data

US 2021/0189819 A1 Jun. 24, 2021

Related U.S. Application Data

(60) Provisional application No. 62/571,415, filed on Oct. 12, 2017.

(51) Int. Cl.
*E21B 19/22* (2006.01)
*E21B 23/12* (2006.01)
*E21B 41/00* (2006.01)

(52) U.S. Cl.
CPC ..... *E21B 23/12* (2020.05); *E21B 19/22* (2013.01); *E21B 41/0035* (2013.01)

(58) Field of Classification Search
CPC ..... E21B 19/22; E21B 23/08; E21B 23/12; E21B 41/0035
See application file for complete search history.

(56) References Cited

U.S. PATENT DOCUMENTS 5,394,951 A * 3/1995 Pringle ..... E21B 4/18 175/45
6,349,768 B1 2/2002 Leising
(Continued)

FOREIGN PATENT DOCUMENTS

EP 2183465 B1 8/2011
WO WO-2016053324 A1 * 4/2016 ..... E21B 47/12

OTHER PUBLICATIONS

First Exam Report issued in Saudi Arabian Patent Application No. 520411757 dated Jun. 29, 2022, 7 pages.

*Primary Examiner* — Matthew R Buck
(74) *Attorney, Agent, or Firm* — Michael L. Flynn

(57) ABSTRACT

A bottom hole assembly (BHA) operable to be conveyed within a wellbore extending into a subterranean formation from a wellsite surface via coiled tubing. The BHA may operable to receive a fluid pumped from the wellsite surface via the coiled tubing. The BHA may include a fluid control tool comprising a first fluid passage extending longitudinally through the fluid control tool and a plurality of first fluid outlets extending radially between the first fluid passage and the wellbore. The fluid control tool may be selectively operable to close the first fluid passage and open the plurality
(Continued)

of first fluid outlets to pass the fluid into the wellbore via the plurality of first fluid outlets, and close the plurality of first fluid outlets and open the first fluid passage to pass the fluid through first fluid passage. The BHA may further include a tractor operable to move the BHA along the wellbore coupled downhole from the fluid control tool. The tractor may have a second fluid passage fluidly connected with the first fluid passage. The BHA may also include a fluid outlet sub coupled downhole from the tractor having a plurality of second fluid outlets fluidly connected with the first fluid passage and extending radially outward to fluidly connect the second fluid passage and the wellbore, and a bent sub coupled downhole from the fluid outlet sub and operable for steering the BHA.

17 Claims, 5 Drawing Sheets

(56) References Cited

U.S. PATENT DOCUMENTS

| | | | | |
|---|---|---|---|---|
| 9,279,301 | B2 * | 3/2016 | Lovorn | E21B 21/08 |
| 2001/0022241 | A1 | 9/2001 | Portman et al. | |
| 2007/0107943 | A1 | 5/2007 | Mock et al. | |
| 2011/0017448 | A1 | 1/2011 | Pipchuk et al. | |
| 2013/0025878 | A1 | 1/2013 | Burgos et al. | |
| 2016/0069146 | A1 * | 3/2016 | Livescu | E21B 43/25 166/177.6 |

* cited by examiner

COILED TUBING ELECTRONICALLY CONTROLLED MULTILATERAL ACCESS OF EXTENDED REACH WELLS

CROSS-REFERENCE TO RELATED APPLICATION(S)

This application claims the benefit of U.S. Provisional Application Ser. No. 62/571,415, filed Oct. 12, 2017 which is incorporated by reference herein.

BACKGROUND

To improve efficiency of reservoir-contact and overall well construction cost reduction, contemporary wellbore completions often have secondary wellbores (i.e., laterals or sidetracks) drilled off of the main wellbore. Oftentimes, two or more laterals can be drilled at various depths and departure angles. However, accessing the laterals during later phase (e.g., well completion) can be challenging.

Coiled tubing is a technology that has been expanding its range of application since its introduction to the oil industry in the 1960's. Its ability to pass through completion tubulars and the wide array of tools and technologies that may be used in conjunction with it make coiled tubing a versatile technology. Typical coiled tubing apparatus include surface pumping facilities, a coiled tubing string mounted on a reel, a method to convey the coiled tubing into and out of the wellbore (such as an injector head or the like), and surface control apparatus at the wellhead. Coiled tubing has been utilized for performing well treatment and/or well intervention operations in existing wellbores, such as, but not limited to, hydraulic fracturing, matrix acidizing, milling, perforating, coiled tubing drilling, and the like.

A coiled tubing intervention operation may utilize an angled arm, which is placed at a bottom of the coiled tubing string and manipulated in an attempt to steer the coiled tubing string into an intended lateral. Coiled tubing intervention access into the laterals can be accomplished by deploying a bent-sub at an end of a coiled tubing bottom hole assembly (BHA) and using hydraulic control to manipulate the bent-sub in an attempt to access a lateral junction. The bend-sub is then rotated at various angles while passing the BHA over the lateral junction, and a pressure signature may confirm lateral contact. While such profiling operation is a proven operation, profiling introduces a fluid to the formation, does not provide a clear confirmation that a lateral has been accessed, is incompatible with hydraulic tractor technologies utilized for extended reach wells, and permits only one lateral to be accessed per run in hole.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
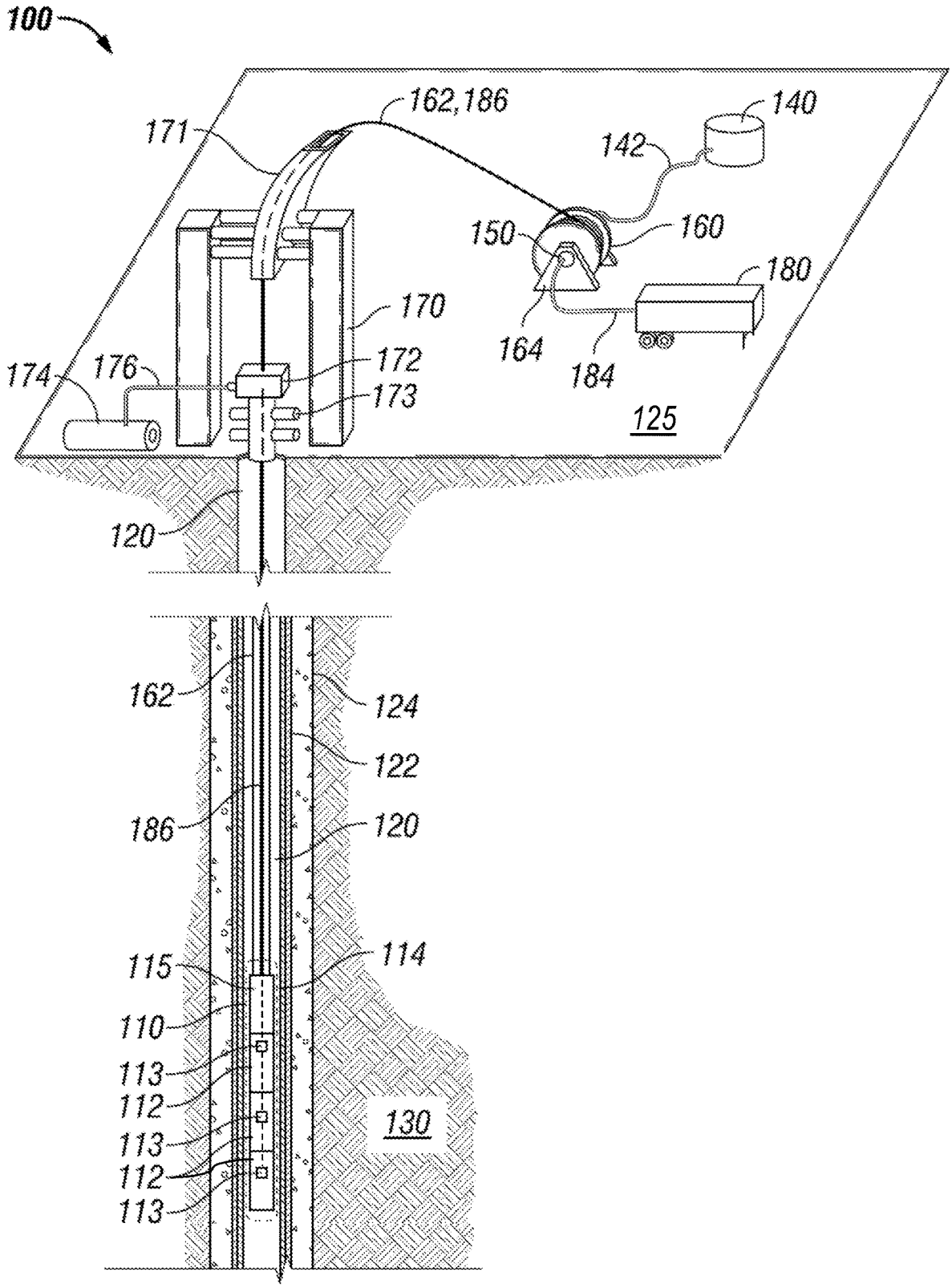
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of an example wellsite system 100 according to one or more aspects of the present disclosure, representing an example coiled tubing environment in which one or more apparatus described herein may be implemented, including to perform one or more methods and/or processes also described herein. However, it is to be understood that aspects of the present disclosure are also applicable to implementations in which wireline, slickline, and/or other conveyance means are utilized instead of or in addition to coiled tubing.

FIG. 1 depicts a wellsite surface 125 upon which various wellsite equipment is disposed proximate a wellbore 120. FIG. 1 also depicts a sectional view of the Earth below the wellsite surface 125 containing the wellbore 120, as well as a bottom hole assembly (BHA) 110 (i.e., a tool string) conveyed within the wellbore 120. The wellbore 120 extends from the wellsite surface 125 into one or more subterranean formations 130. When utilized in cased-hole implementations, a cement sheath 124 may secure a casing 122 within the wellbore 120. However, one or more aspects of the present disclosure are also applicable to open-hole implementations, in which the cement sheath 124 and the casing 122 have not yet been installed in the wellbore 120.

At the wellsite surface 125, the wellsite system 100 may comprise a control center 180 comprising processing and communication equipment operable to send, receive, and process electrical and/or optical signals. The control center 180 is operable to control at least some aspects of operations of the wellsite system 100.

The control center 180 may further comprise an electrical power source operable to supply electrical power to components of the wellsite system 100, including the BHA 110. The electrical signals, the optical signals, and the electrical power may be transmitted between the control center 180 and the BHA 110 via conduits 184, 186 extending between the control center 180 and the BHA 110. The conduits 184, 186 may each comprise one or more electrical conductors, such as electrical wires, lines, or cables, which may transmit electrical power and/or electrical control signals from the control center 180 to the BHA 110, as well as electrical sensor, feedback, and/or other data signals from the BHA 110 to the control center 180. The conduits 184, 186 may each further comprise, or comprise only one or more optical conductors, such as fiber optic cables, which may transmit light pulses and/or other optical signals (hereafter collectively referred to as optical signals) between the control center 180 and the BHA 110.

The conduits 184, 186 may collectively comprise a plurality of conduits or conduit portions interconnected in series and/or in parallel and extending between the control center 180 and the BHA 110. For example, as depicted in the example implementation of FIG. 1, the conduit 184 extends between the control center 180 and a reel 160 of coiled tubing 162, such that the conduit 184 may remain substantially stationary with respect to the wellsite surface 125. The conduit 186 extends between the reel 160 and the BHA 110 via the coiled tubing 162, including the coiled tubing 162 spooled on the reel 160. Thus, the conduit 186 may rotate and otherwise move with respect to the wellsite surface 125. The reel 160 may be rotatably supported on the wellsite surface 125 by a stationary base 164, such that the reel 160 may be rotated to advance and retract the coiled tubing 162 within the wellbore 120. The conduit 186 may be contained within an internal passage of the coiled tubing 162, secured externally to the coiled tubing 162, or embedded within the structure of the coiled tubing 162. A rotary joint 150, such as may be known in the art as a collector, provides an interface between the stationary conduit 184 and the moving conduit 186. In embodiments, the collector or the rotary joint 150 may be configured and/or utilized to transmit data wirelessly between the control center 180 and the BHA 110, among other components.

The wellsite system 100 may further comprise a fluid source 140 from which a fluid may be conveyed by a fluid conduit 142 to the reel 160 of coiled tubing 162. The fluid conduit 142 may be fluidly connected to the coiled tubing 162 by a swivel or other rotating coupling (obstructed from view in FIG. 1). The coiled tubing 162 may be utilized to convey the fluid received from the fluid source 140 to the BHA 110 coupled at the downhole end of the coiled tubing 162 within the wellbore 120.

The wellsite system 100 may further comprise a support structure 170, such as may include or otherwise support a coiled tubing injector 171 and/or other apparatus operable to facilitate movement of the coiled tubing 162 in the wellbore 120. Other support structures may be also included, such as a derrick, a crane, a mast, a tripod, and/or other structures. A diverter 172, a blow-out preventer (BOP) 173, and/or a fluid handling system 174 may also be included as part of the wellsite system 100. For example, during deployment, the coiled tubing 162 may be passed from the injector 171, through the diverter 172 and the BOP 173, and into the wellbore 120. The BHA 110 may be conveyed along the wellbore 120 via the coiled tubing 162 in conjunction with the coiled tubing injector 171, such as may be operable to apply an adjustable uphole and downhole force to the coiled tubing 162 to advance and retract the BHA 110 within the wellbore 120.

During some downhole operations, fluid may be conveyed through the coiled tubing 162 and may exit into the wellbore 120 adjacent to the BHA 110. For example, the fluid may be directed into an annular area (i.e., annulus) between the sidewall of the wellbore 120 and the BHA 110 through one or more ports (not shown) in the coiled tubing 162 and/or the BHA 110 to perform an intended well treatment or other downhole operation. If some or all of the fluid flows in the uphole direction, the diverter 172 may direct the returning fluid out of the wellbore 120 to the fluid handling system 174 through one or more conduits 176. The fluid handling system 174 may be operable to clean the fluid and/or prevent the fluid from escaping into the environment. The fluid may then be returned to the fluid source 140 or otherwise contained for later use, treatment, and/or disposal.

The BHA 110 may be a single or multiple modules, sensors, and/or tools 112, hereafter collectively referred to as the tools 112. For example, the BHA 110 and/or one or more of the tools 112 may be or comprise at least a portion of a monitoring tool, an acoustic tool, a density tool, a drilling tool, an electromagnetic (EM) tool, a formation testing tool, a fluid sampling tool, a formation logging tool, a formation measurement tool, a gravity tool, a magnetic resonance tool, a neutron tool, a nuclear tool, a photoelectric factor tool, a porosity tool, a reservoir characterization tool, a resistivity tool, a seismic tool, a surveying tool, a tough logging condition (TLC) tool, a perforating guns or other perforating tool, a plug setting tool, a plug, a tractor, a fluid control tool, and/or a bent sub among other examples within the scope of the present disclosure. The conduit 186 may extend through one or more of the downhole tools 112, such as may facilitate communication between the control center 180 and the downhole tools 112 and transmission of electrical power from the wellsite surface 125 to the downhole tools 112.

One or more of the tools 112 may be or comprise a casing collar locator (CCL) operable to detect ends of casing collars by sensing a magnetic irregularity caused by the relatively high mass of an end of a collar of the casing 122. One or more of the tools 112 may also or instead be or comprise a gamma ray (GR) tool that may be utilized for depth correlation. The CCL and/or GR tools may transmit signals in real-time to wellsite surface equipment, such as the control center 180, via the conduits 184, 186. The CCL and/or GR tool signals may be utilized to determine the position of the BHA 110, such as with respect to known casing collar numbers and/or positions within the wellbore 120. Therefore, the CCL and/or GR tools may be utilized to detect and/or log the location of the BHA 110 within the wellbore 120, such as during intervention operations as described below.

One or more of the tools 112 may also comprise one or more sensors 113. The sensors 113 may include inclination and/or other orientation sensors, such as accelerometers, magnetometers, gyroscopic sensors, and/or other sensors for utilization in determining the orientation of the BHA 110 relative to the wellbore 120. The sensors 113 may also or instead include sensors for utilization in determining petrophysical and/or geophysical parameters of a portion of the formation 130 along the wellbore 120, such as for measuring and/or detecting one or more of pressure, temperature, strain, composition, and/or electrical resistivity, among other examples within the scope of the present disclosure. The sensors 113 may also or instead include fluid sensors for utilization in detecting the presence of fluid, a certain fluid, or a type of fluid within the BHA 110 or the wellbore 120. The sensors 113 may also or instead include fluid sensors for utilization in measuring properties and/or determining composition of fluid sampled from the wellbore 120 and/or the formation 130, such as spectrometers, fluorescence sensors, optical fluid analyzers, density sensors, viscosity sensors, pressure sensors, and/or temperature sensors, among other examples within the scope of the present disclosure. Although the tools 112 are shown and described as comprising one or more sensors 113, it is to be understood that one or more of the tools 112 may not comprise sensors 113.

The wellsite system 100 may also include a telemetry system comprising one or more downhole telemetry tools 115 (such as may be implemented as one or more of the tools 112) and/or a portion of the control center 180 to facilitate communication between the BHA 110 and the control center 180. The telemetry system may be a wired electrical telemetry system and/or an optical telemetry system, among other examples.

Figure 2:
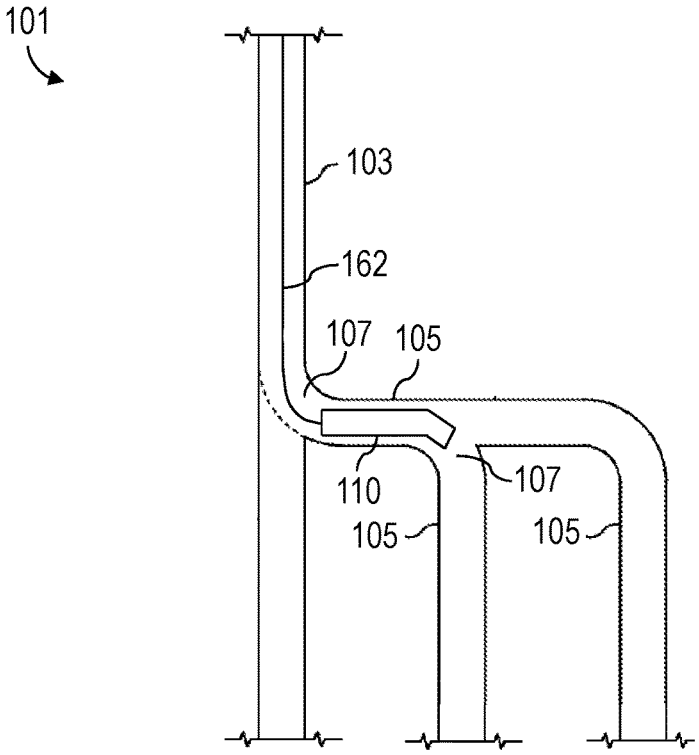
FIG. 2 is a schematic view of at least a portion of an example implementation of apparatus according to one or more aspects of the present disclosure.
Figure 3:
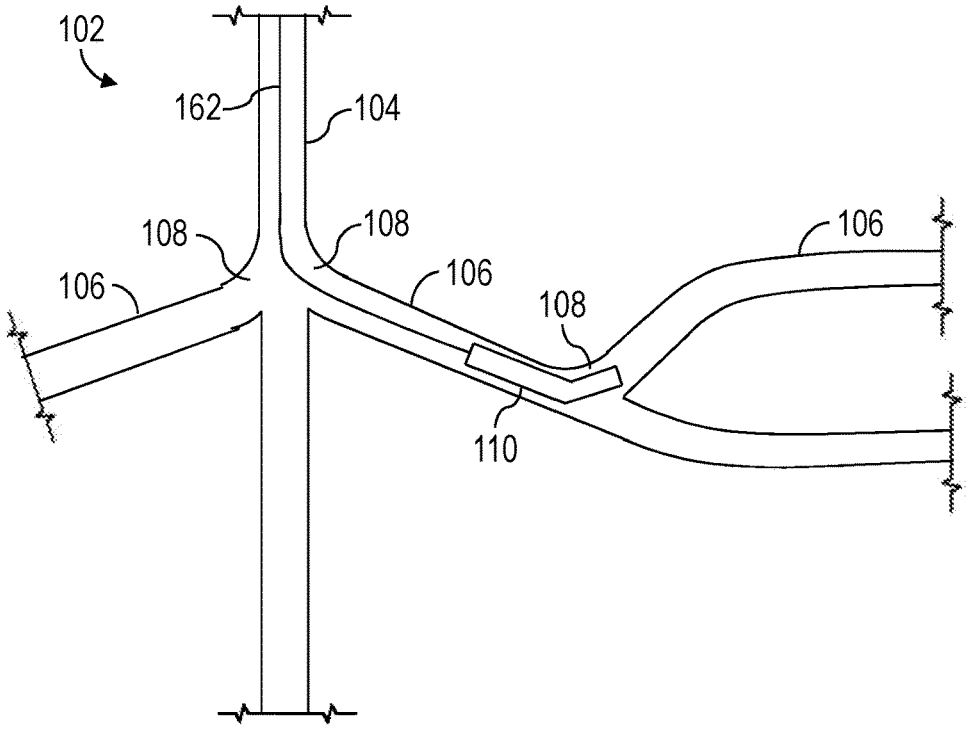
FIG. 3 is a schematic view of at least a portion of an example implementation of apparatus according to one or more aspects of the present disclosure.

FIGS. 2 and 3 are schematic views of a portion of example wellbore systems 101, 102, each comprising a main substantially vertical wellbore 103, 104 and a plurality of corresponding lateral wellbores 105, 106 extending from each wellbore 103, 104 at corresponding lateral junctions 107, 108. The wellbore systems 101, 102 represent example wellbore systems in which a downhole tool system within the scope of the present disclosure, such as the BHA 110 described above, may be utilized, including to perform one or more methods and/or processes according to one or more aspects of the present disclosure. For example, the BHA 110 may be steered and conveyed into one or more of the lateral wellbores 105, 106 to perform coiled tubing intervention operations according to one or more aspects of the present disclosure.

Figure 4:
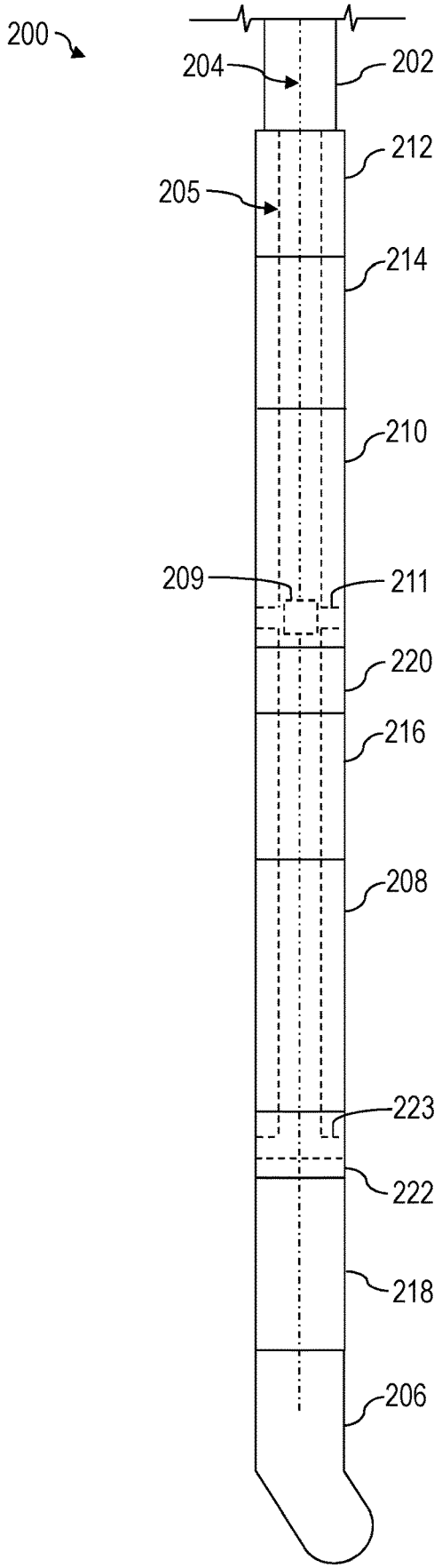
FIG. 4 is a schematic view of at least a portion of an example implementation of apparatus according to one or more aspects of the present disclosure.

FIG. 4 is a schematic view of at least a portion of an example implementation of the BHA 110 shown in FIGS. 1-3 and designated in FIG. 4 by numeral 200. The following description refers to FIGS. 1-4, collectively.

The BHA 200 is coupled with a coiled tubing string 202 on one end and comprises a plurality of downhole subs, tools, and/or segments (hereinafter collectively referred to as "tools") coupled together to form the BHA 200. A power and/or communication conduit 204 extends through at least a portion of the BHA 200, such as may facilitate communication between two or more of the downhole tools of the BHA 200. The conduit 204 may extend from the BHA 200 to the control center 180 or other surface equipment located at the wellsite surface 125 through or along the coiled tubing 162, 202 such as may facilitate communication and transmission of electrical power between the control center 180 and one or more tools of the BHA 200. The conduit 204 extending through the BHA 200 may comprise a plurality of conduits or conduit segments interconnected in series and/or in parallel, each associated with a corresponding downhole tool of the BHA 200. The conduit 204 may comprise one or more electrical conductors, such as electrical wires, lines, or cables, which may transmit electrical power and/or electrical control signals. The conduit 204 may further comprise, or comprise only one or more optical conductors, such as fiber optic cables, which may transmit light pulses and/or other optical signals. The optical conductors of the conduit 204 may provide surface to tool telemetry and/or fiber-optic distributed measurements (e.g., temperature and pressure measurements). In addition to, or in lieu of, electrical power being supplied to the BHA 200 from the conduit 204, the BHA 200 may comprises a battery or batteries as a part of the BHA for supplying electrical power to the BHA 200. In an embodiment, the components or tools of the BHA 200 may communicate wirelessly with other components or tools of the BHA 200.

An axial or otherwise longitudinal oriented fluid passage 205 (e.g., a bore) extends through at least a portion of the BHA 200, such as may permit a working fluid (e.g., a treatment fluid, a stimulation fluid, water, or water-based fluid, or a gaseous fluid such as gaseous nitrogen) to pass from the coiled tubing 202 into and through at least a portion of the BHA 200. The fluid passage 205 extending through the BHA 200 may comprise a plurality of interconnected individual fluid passages or passage segments, each provided by a corresponding downhole tool of the BHA 200. One or more portions of the conduit 204 may extend through the passage 205 and/or through walls of the tools forming the BHA 200 and defining the passage 205.

The BHA 200 comprises a multi-lateral tool, such as a bent sub 206, at a downhole end of the BHA 200 to steer the BHA 200 into an intended lateral wellbore 105, 106. The bent sub 206 may be electrically controlled (i.e., steered). The bent sub 206 may be a no flow downhole tool, such as may not include an internal flow pathway (e.g., a portion of the passage 205) for passing the working fluid through the bent sub 206. The bent sub 206 may also not include fluid outlets for directing the working fluid out of the bent sub 206. Thus, the BHA 200 facilitates electronic control of the bent sub 206 to facilitate lateral junction profiling, without having to pump the working fluid from the wellsite surface 125 to manipulate the bent-sub 206. The bent sub 206 may be operated based on control signals received from the wellsite surface 125 via the conduit 186 and/or based on one or more downhole properties detected by one or more of the downhole tools described herein.

The BHA 200 may also include a hydraulic tractor 208 coupled uphole from the bent sub 206 and comprising a portion of the fluid passage 205 configured to pass the working fluid through the tractor 208. The tractor 208 may be operated based on control signals received from the wellsite surface 125 along the conduit 204 and/or based on one or more downhole properties detected by one or more of the downhole tools described herein.

The BHA 200 permits electrical control of fluid flow paths extending through and out of the BHA 200, such as to direct the working fluid through the BHA 200 or divert the working fluid out of the BHA 200 into an annulus of the wellbore containing the BHA 200. Such fluid flow control permits sensitive tools (e.g., the bent sub 206, the tractor 208) of the BHA 200 to be isolated and/or protected from large volumes of working fluid (e.g., acid) and facilitates means for high-rate fluid pumping into the annulus uphole from the sensitive tools without passing the fluid through the entire BHA 200.

Accordingly, the BHA 200 comprises an electrical circulation sub (ECS) 210 operable to control fluid flow direction, such as to selectively divert the working fluid flowing through the passage 205 into the annulus (jetting operation) to perform well stimulation or other treatment. The ECS 210 may also permit the working fluid to pass through the ECS 210 and into a portion of the BHA 200 located downhole from the ECS 210, such as to facilitate other downhole operations (e.g., to control tractor operation).

The ECS 210 may comprise one or more fluid control valves 209 or other fluid control members (e.g., balls, flappers, etc.) selectively operable to block fluid flow through the passage 205 and to divert the fluid out of the ECS 210 into the annulus of the wellbore via one or more radially oriented fluid outlets 211 (e.g., ports). The fluid control valve 209 may be operable to permit fluid flow through the passage 205 and to prevent fluid flow out of the ECS 210 via the fluid outlets 211. The fluid control valve 209 may be progressively operable, permitting the passage 205 and/or the outlets 211 to be progressively (i.e., partially) opened and, thus, facilitating adjustable fluid flow control via the passage 205 and/or the outlets 211. The fluid control valve 209 may be selectively operated by an actuator (not shown) mechanically or otherwise operatively connected with the fluid control valve 209. The valve actuator may be, for example, an electrical actuator, such as a solenoid, an electrical motor, or an electrical linear actuator, or the actuator may be a hydraulic actuator, such as a hydraulic cylinder or motor. The valve actuator may be electrically connected with the conduit 204, such as may permit the fluid control valve 209 to be actuated from the wellsite surface 125 and/or via a control signal generated by one or more of the downhole tools. Position of the fluid control valve 209 and/or the valve actuator may be monitored via one or more sensors (not shown) operable to monitor position of the fluid control valve 209.

The ECS 210 may be operable to protect one or more of the tools of the BHA 200 from thousands (e.g., 5,000-15,000) of barrels (bbl) of working fluid (e.g., acid) conveyed per run by diverting the working fluid into the annulus via the fluid outlets 211. The fluid outlets 211 may comprise a predetermined size (e.g., inside diameter) or comprise therein predetermined fluid nozzles sized to optimize acid stimulation or other downhole operations. The fluid outlets 211 of the ECS 210 may be selectively opened and closed via the fluid control valve 209, such as to facilitate on-demand fluid flow control operable via electric power. The ECS 210 may facilitate multiple lateral wellbore access and stimulation without pulling the BHA 200 to the wellsite surface 125 to be redressed.

The BHA 200 according to one or more aspects of the present disclosure may further comprise an optical motor head assembly (OMHA) 212, such as having a standard downhole contingency functionality and a combined optical fiber telemetry line. The BHA 200 may further comprise a pressure-temperature-casing (PTC) collar locator module 214, which may be or operate as the main control center or the "brain" of the downhole measurement system. The BHA 200 may also comprise a tension and compression (TC) tool 216 operable to provide downhole weight (i.e., tension or compression) and/or torque readings for the BHA 200. The TC tool 212 may enhance tractor 208 control operations and provide feedback to the control center 180 indicative of BHA 200 movement and bent sub 206 sensitivity. The BHA 200 may also include a navigation tool 218, which may comprise a direction and inclination sensors and/or a GR module. The navigation tool 218 may be a no flow tool, which may not include a portion of the fluid passage 205 for passing the working fluid downhole through the navigation tool 218 or outlet ports for directing the working fluid out of the navigation tool 218 into the annulus of the wellbore.

The fluid control valve 209 may be operated based on one or more downhole properties detected by one or more of the downhole tools 214, 216, 218 and/or based on control signals received from the wellsite surface 125 via the conduit 204 and the OMHA 212. For example, the fluid control valve 209 may be operated based on a control signal received from the wellsite surface 125 via a telemetry portion of the conduit 186, 204. The fluid control valve 209 may also be operated based on distributed temperature measurements generated by the fiber-optic conductor of the conduit 186. Similarly, the tractor 208 may be operated based on tension, compression, and/or torque measurements generated by the TC tool 216.

The BHA 200 may also comprise one or more sondes 220, 222 (i.e., mechanical modules) operable to provide a portion of the fluid passage 205 for passing the working fluid and/or to provide a passage for the conduit 204 (i.e., a control line). For example, the sonde 220 may provide a passage for the conduit 204 to be passed through the TC tool 216 and the tractor 208 and, thus, provide power and/or telemetry to the tools below the tractor 208. The sonde 222 may be a fluid outlet sub, comprising one or more features of the sonde 220 and also fluid outlets 223 (i.e., ports), such as may prevent further flow of the working fluid via the BHA 200 by directing the working fluid out of the BHA 200 into the annulus downhole from the tractor 208 and uphole from the navigation tool 218 and the bent sub 206.

Consequently, the BHA 200 according to one or more aspects of the present disclosure may facilitate the ability to map and navigate into the lateral wellbores 105, 106 without having to pump the working fluid through the bent sub 206. Because portions of the BHA 200 do not include the fluid passage 205 extending therethrough (e.g., the navigation tool 218, the bent sub 206), the BHA 200 may comprise a slimmer configuration, for example, having an outside diameter(s) of about 5.398 centimeters (2.125 inches) or smaller. Electrical power and control facilitates independent control and/or operation of the tractor 208 and the bent sub 206. As one or more portions of the BHA 200 may be isolated from the working fluid and/or come into contact with the working fluid at a substantially reduced rate, the BHA 200 may be fully compatible with working fluids, such as acids or other stimulation fluids. The BHA 200 may be operable to access multiple (e.g., two to five or more) lateral wellbores 105, 106 in a single downhole run. The BHA 200 may further permit lateral wellbore access confirmation, such as by utilizing one or more downhole measurements (e.g., casing collar location, gamma, direction, inclination, and/or azimuth). The BHA 200 may also facilitate tool power and telemetry combined with fiber-optic sensing in the same stimulation fluid compatible tether (e.g., cable/control line).

Figure 5:
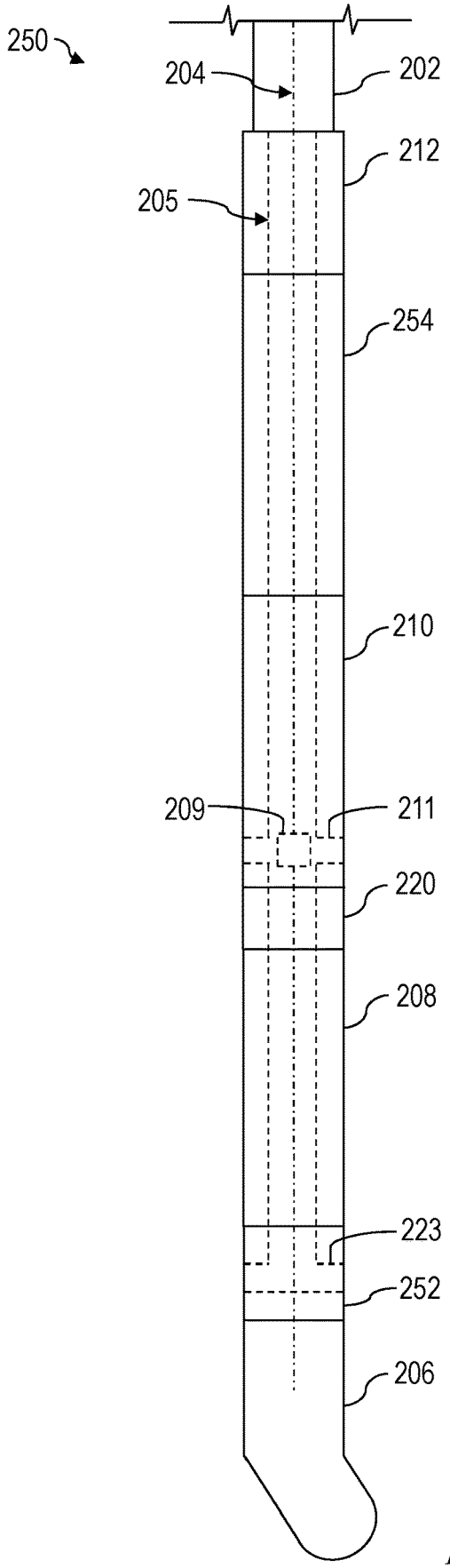
FIG. 5 is a schematic view of at least a portion of an example implementation of apparatus according to one or more aspects of the present disclosure.

FIG. 5 is a schematic view of another example implementation of the BHA 200 shown in FIG. 4 and designated in FIG. 5 by numeral 250. The BHA 250 comprises one or more features of the BHA 200, including where indicated by like reference numbers, except as described below. The following description refers to FIGS. 1-3 and 5, collectively.

Similarly to the BHA 200, the BHA 250 facilitates electronic control of fluid flow paths through the BHA 250, such as to selectively direct the working fluid through the BHA 250 or to divert the working fluid into the annulus of the wellbore. However, one or more tools or other portions of the BHA 250 may be larger, comprising an outside diameter that is substantially larger than the outside diameter of the tools forming the BHA 200. The larger diameter BHA 250 may permit higher pumping (i.e., flow) rates and/or to support a larger hydraulic tractor. For example, one or more tools or other portions of the BHA 200 may have an outside diameter of about 7.303 centimeters (2.875 inches) or larger. Although one or more tools of the BHA 250 are physically larger than the corresponding tools of the BHA 200, the same reference numbers are used to identify the tools of the BHA 250 to indicate these tools otherwise comprise the same or similar structure and/or mode of operation.

Furthermore, instead of comprising separate navigation tool 218, TC tool 216, and PCT locator module 214, the BHA 250 may comprise a single larger diameter combination navigation and control tool 252 operable to perform the operations of the navigation tool 218, the TC tool 216, and the PCT locator module 214.

Figure 6:
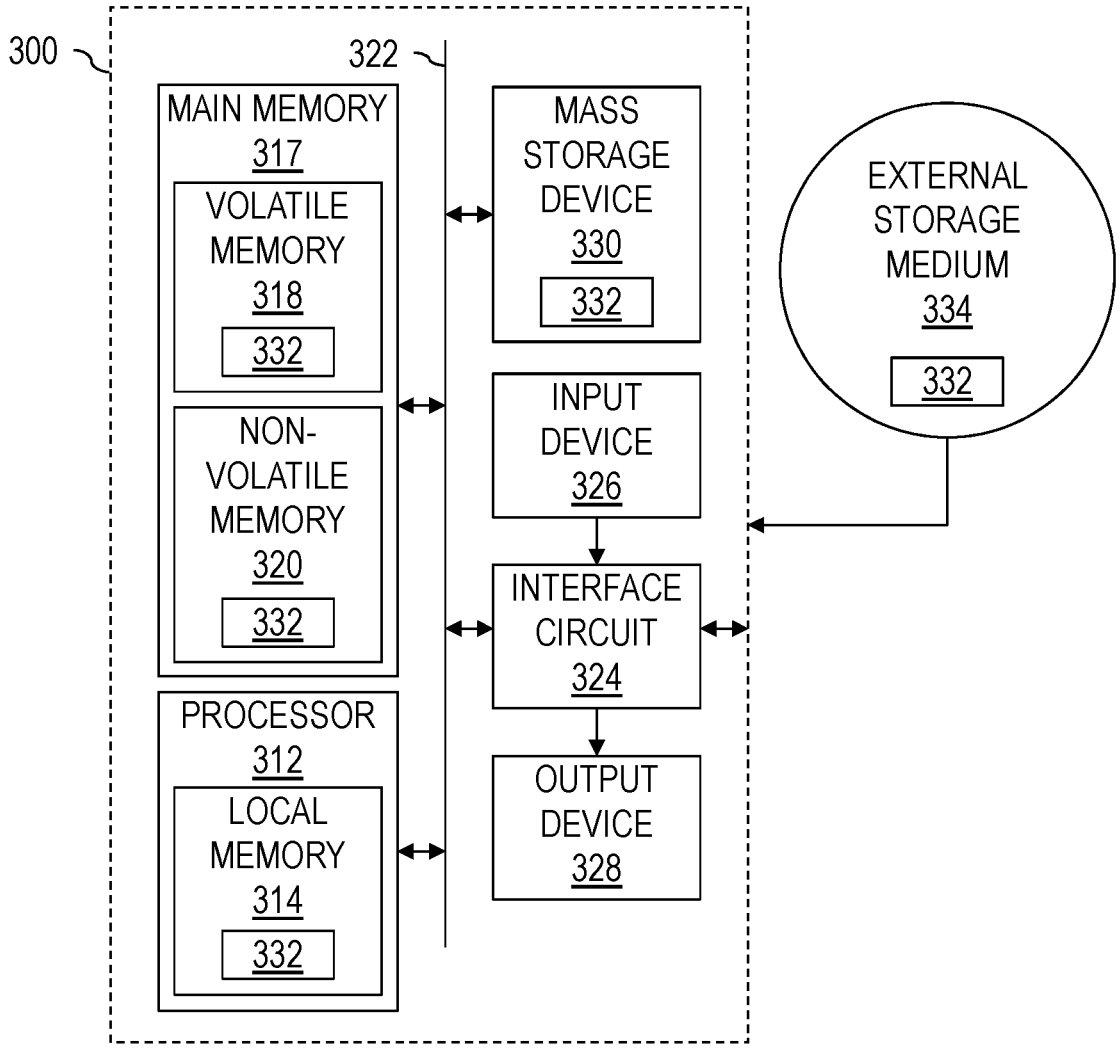
FIG. 6 is a schematic view of at least a portion of an example implementation of apparatus according to one or more aspects of the present disclosure.

FIG. 6 is a schematic view of at least a portion of an example implementation of a processing device 300 according to one or more aspects of the present disclosure. The processing device 300 may execute example machine-readable instructions to implement at least a portion of one or more of the methods and/or processes described herein, and/or to implement a portion of one or more of the example downhole tools described herein. The processing device 300 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the processing device 300 shown in FIG. 6 is implemented within one or more tools of the BHA 110, 200, 250 described above, one or more components or functions of the processing device 300 may also or instead be implemented in wellsite surface equipment, perhaps including the control center 180 depicted in FIG. 1.

The processing device 300 may comprise a processor 312, such as a general-purpose programmable processor, for example. The processor 312 may comprise a local memory 314, and may execute program code instructions 332 present in the local memory 314 and/or another memory device. The processor 312 may execute, among other things, machine-readable instructions or programs to implement the methods and/or processes described herein. The programs stored in the local memory 314 may include program instructions or computer program code that, when executed by an associated processor, cause a controller and/or control system implemented in surface equipment and/or a downhole tool to perform tasks as described herein. The processor 312 may be, comprise, or be implemented by one or more processors of various types operable in the local application environment, and may include one or more general-purpose processors, special-purpose processors, microprocessors, digital signal processors (DSPs), field-programmable gate arrays (FPGAs), application-specific integrated circuits (ASICs), processors based on a multi-core processor architecture, and/or other processors.

The processor 312 may be in communication with a main memory 317, such as via a bus 322 and/or other communication means. The main memory 317 may comprise a volatile memory 318 and a non-volatile memory 320. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or the non-volatile memory 320.

The processing device 300 may also comprise an interface circuit 324. The interface circuit 324 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 324 may also comprise a graphics driver card. The interface circuit 324 may also comprise a communication device, such as a modem or network interface card, to facilitate exchange of data with external computing devices via a network, such as via Ethernet connection, digital subscriber line (DSL), telephone line, coaxial cable, cellular telephone system, and/or satellite, among other examples.

One or more input devices 326 may be connected to the interface circuit 324. One or more of the input devices 326 may permit a user to enter data and/or commands for utilization by the processor 312. Each input device 326 may be, comprise, or be implemented by a keyboard, a mouse, a touchscreen, a track-pad, a trackball, an image/code scanner, and/or a voice recognition system, among other examples.

One or more output devices 328 may also be connected to the interface circuit 324. One or more of the output devices 328 may be, comprise, or be implemented by a display device, such as a liquid crystal display (LCD), a light-emitting diode (LED) display, and/or a cathode ray tube (CRT) display, among other examples. One or more of the output devices 328 may also or instead be, comprise, or be implemented by a printer, speaker, and/or other examples.

The processing device 300 may also comprise a mass storage device 330 for storing machine-readable instructions and data. The mass storage device 330 may be connected to the interface circuit 324, such as via the bus 322. The mass storage device 330 may be or comprise a floppy disk drive, a hard disk drive, a compact disk (CD) drive, and/or digital versatile disk (DVD) drive, among other examples. The program code instructions 332 may be stored in the mass storage device 330, the volatile memory 318, the non-volatile memory 320, the local memory 314, and/or on a removable storage medium 334, such as a CD or DVD.

The mass storage device 330, the volatile memory 318, the non-volatile memory 320, the local memory 314, and/or the removable storage medium 334 may each be a tangible, non-transitory storage medium. The modules and/or other components of the processing device 300 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The present disclosure is further directed to one or more methods. The methods described below and/or other operations described herein may be performed utilizing or otherwise in conjunction with at least a portion of one or more implementations of one or more instances of the apparatus shown in one or more of FIGS. 1-6 and/or otherwise within the scope of the present disclosure. However, the methods and operations described herein may be performed in conjunction with implementations of apparatus other than those depicted in FIGS. 1-6 that are also within the scope of the present disclosure. The methods and operations may be performed manually by one or more human operators and/or performed or caused, at least partially, by the processing device 300 executing coded instructions 332 according to one or more aspects of the present disclosure. For example, the processing device 300 may receive input signals and automatically generate and transmit output signal to operate or cause a change in an operational parameter of one or more pieces of the wellsite equipment described above. However, the human operator may also or instead manually operate the one or more pieces of wellsite equipment via the processing device based on sensor signals displayed.

One of the methods within the scope of the present disclosure may be or comprise conveying the BHA 200, 250 in hole to a target depth. As the BHA 200, 250 is run in-hole (RIH), the ECS 210 may be operated to permit the working fluid to pass thru the BHA 200, 250. The working fluid may be pumped from the wellsite surface 125 via the coiled tubing 162 and through the tractor 208 at low rates to aide with the conveyance process, such as for lubrication and/or circulating debris. Once the tractor 208 is intended to be operated (i.e., engaged), the pumping (i.e., flow) rate of the working fluid may be increased to reach a predetermined "tractoring" fluid flow and/or pressure to operate the tractor 208. Thus, the use, the type, and/or the quantity of the working fluid may be controlled, limited, or reduced to instances when use of the tractor 208 is needed to achieve maximum or otherwise intended (i.e., target) well depth. Once at the intended depth is reached, the fluid pumping may be stopped while lateral access operation is initiated.

Another method within the scope of the present disclosure may be or comprise performing profiling operations. Such method may comprise utilizing the depth correlation functions of the PTC collar locator module 214 and/or the navigation tool 218 to position the BHA 200, 250 within a hole (e.g., the wellbore 104, the lateral wellbore 105, 106) just below (i.e., downhole from) the wellbore lateral junction 107, 108. Thereafter, the bent sub 206 may be engaged via an electronic signal, the BHA 200, 250 may be pulled out of the hole past the lateral junction 107, 108 while a surface acquisition system of the control center 180 at the wellsite surface 125 monitors the BHA 200, 250 to validate a change in the position of the bent sub 206 (change in position confirms lateral junction contact). If the lateral junction 107, 108 is not identified, the BHA 200, 250 may be ran back in hole, the bent-sub 206 may be rotated or deflected between about 10 and 20 degrees or another angle with respect to an axis of the BHA 200, 250, such as that disclosed in U.S. Pat. No. 6,349,768, incorporated by reference herein in its entirety, and the BHA 200, 250 may be pulled out of the hole past the lateral junction 107, 108 while the surface acquisition system validates the change in rotational position of the bent sub 206. Such process may be repeated until a confirmation that the bent sub 206 is in the lateral junction is received. The BHA 200, 250 may then be lowered into an intended lateral wellbore 105, 106, which may be confirmed via the gamma and/or direction and inclination measurements of the navigation tool 218. The BHA 200, 250 may then be lowered into the intended lateral wellbore 105, 106 with or without utilizing the tractor 208, as described above.

Still another method within the scope of the present disclosure may be or comprise performing stimulation treatment (e.g., acidizing) of the well. Once the BHA 200, 250 reaches the target depth, the ECS 210 may be operated to divert the working fluid flowing through the BHA 200, 250 into the annulus of the lateral wellbore 105, 106 via the fluid outlets 211, ensuring that no volume of acid is pumped through the tractor 208. Once the stimulation treatment is completed, the fluid control valve 209 of the ECS 210 may be operated to close the outlets 211 and pass the working fluid through the BHA 200, 250 downhole from the ECS 210 and the tractor 208. The processes described above may be repeat for a plurality of lateral wellbores 107, 108 without pulling the BHA 200, 250 to the wellsite surface 125 for redress.

In view of the entirety of the present disclosure, including the figures, a person having ordinary skill in the art will recognize that the present disclosure is directed to an apparatus operable to control or steer a downhole apparatus into a wellbore lateral junction based on electrical signals sent from a wellsite surface for well intervention treatment. For example, the apparatus may be operable to completely rotate, partially rotate, completely incline, and/or partially incline a bottom end of a downhole tool based on a signal/command sent via a telemetry conduit on demand from a wellsite surface.

The present disclosure is further directed to an apparatus operable to map the wellbore lateral junction dimensions by determining status and position of the downhole apparatus for well intervention treatment. For example, the apparatus may be operable to read an electrical signal to determine positioning as well as one or more of a rotation status, an inclination status, and an extension status of the bottom end of a downhole apparatus.

The present disclosure is further directed to an apparatus operable to control or direct the path of fluid pumped from a wellsite surface conveyed through a wellbore lateral junction based on electrical signals sent from the wellbore surface for well intervention treatment. For example, the apparatus may be operable to fully open, fully close, and/or partially open a radially oriented fluid pathway in a downhole tool conveyed through a wellbore lateral junction based on a signal/command sent through a telemetry conduit on demand from a wellsite surface. The apparatus may be further operable to fully open, fully close, and/or partially open an axial (e.g., longitudinal) oriented fluid pathway through a downhole tool conveyed through a wellbore lateral junction based on a signal/command sent through a telemetry conduit on demand from a wellsite surface. The apparatus may also be operable to fully open, fully close, and/or partially open another (i.e., randomly oriented) fluid pathway in a downhole tool conveyed through a wellbore lateral junction based on a signal/command sent through a telemetry conduit on demand from a wellsite surface.

The present disclosure is also directed to an apparatus operable to control or direct the path of fluid pumped from the wellsite surface through a wellbore lateral junction based on distributed temperature measurements for well intervention treatment. For example, the apparatus may be operable to fully open fully close, and/or partially open a radially oriented fluid pathway in a downhole tool conveyed through a wellbore lateral junction based on distributed temperature measurements on demand from a wellsite surface. The apparatus may be further operable to fully open, fully close, and/or partially open an axial oriented fluid pathway in a downhole tool conveyed through a wellbore lateral junction based on distributed temperature measurements on demand from surface. The apparatus may also be operable to fully open, fully close, and/or partially open another (i.e., randomly oriented) fluid pathway in a downhole tool conveyed through a wellbore lateral junction based on distributed temperature measurements on demand from surface.

The present disclosure is also directed to an apparatus operable to control or steer a downhole tractor apparatus into a wellbore lateral junction based on downhole load measurements for well intervention treatment. For example, the apparatus may be operable to fully activate, partially activate, and/or stop operating (i.e., tracking) the tractor apparatus of a downhole tool based on tension, compression and torque measurements on demand from surface.

The present disclosure is also directed to an apparatus operable to determine status and position of a valve in a downhole apparatus conveyed through a wellbore lateral junction from a wellsite surface. For example, the apparatus may be operable to read an electrical signal to determine the status and positioning of a linear actuator, a radial actuator, or another actuator that controls the downhole valve.

The present disclosure is still further directed to an apparatus operable to manipulate a valve in a downhole apparatus conveyed through a wellbore junction lateral from the wellsite surface. For example, the apparatus may be operable to send an electrical signal to cause movement of a linear, radial, or another actuator that controls the downhole valve.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus comprising:

a bottom hole assembly (BHA) operable to be conveyed within a wellbore extending into a subterranean formation from a wellsite surface via coiled tubing, wherein the BHA is operable to receive a fluid pumped from the wellsite surface via the coiled tubing, and wherein the BHA comprises:

a fluid control tool comprising a first fluid passage extending longitudinally through the fluid control tool and a plurality of first fluid outlets extending radially between the first fluid passage and the wellbore, wherein the fluid control tool is selectively operable to:

close the first fluid passage and open the plurality of first fluid outlets to pass the fluid into the wellbore via the plurality of first fluid outlets;

close the plurality of first fluid outlets and open the first fluid passage to pass the fluid through the first fluid passage; and partially open and close the first fluid passage and the first fluid outlets to facilitate adjustable fluid control via the first fluid passage and the first fluid outlets; and a bent sub coupled downhole from the fluid control tool and operable for steering the BHA without the need to have fluid pumped therethrough.

2. The apparatus of claim 1 wherein the BHA further comprises a tractor operable to move the BHA along the wellbore coupled downhole from the fluid control tool and uphole from the bent sub, wherein the tractor comprises a second fluid passage fluidly connected with the first fluid passage.

3. The apparatus of claim 2 wherein the BHA further comprises a fluid outlet sub coupled downhole from the tractor and uphole from the bent sub and comprising a plurality of second fluid outlets fluidly connected with the first fluid passage and extending radially outward to fluidly connect the second fluid passage and the wellbore.

4. The apparatus of claim 1 wherein the fluid control tool is actuated by a valve actuator.

5. The apparatus of claim 4 wherein the valve actuator is an electric actuator.

6. The apparatus of claim 4 wherein the valve actuator is a hydraulic actuator.

7. A system for accessing at least one lateral wellbore in a multilateral wellbore, comprising:

a coiled tubing extending from a wellsite surface into the wellbore;

a control center operable to send, receive and process control signals;

a bottom hole assembly (BHA) operable to be conveyed within the wellbore via the coiled tubing, wherein the BHA is operable to receive a fluid pumped from the wellsite surface via the coiled tubing, and wherein the BHA comprises:

an electrical circulation sub comprising a first fluid passage extending longitudinally through the electrical circulation sub and a plurality of first fluid outlets extending radially between the first fluid passage and the wellbore, the electrical circulation sub configured to selectively divert fluid, based on control signals from the control center, from the first fluid passage to the first fluid outlets and the wellbore or to both the first fluid passage and the wellbore; and a bent sub configured to be rotated with respect to an axis of the BHA, the bent sub electronically controlled via control signals from the control center without the need to have the fluid pumped therethrough.

8. The system of claim 7 wherein the electrical circulation sub diverts fluid to protect at least the bent sub from the fluid when performing a downhole operation with the fluid.

9. The system of claim 7 wherein the BHA further comprises a tractor and wherein the electrical circulation sub facilitates operation of the tractor via selectively diverting fluid.

10. The system of claim 7 wherein the BHA further comprises a navigation tool.

11. The system of claim 7 wherein the BHA further comprises a tension compression tool.

12. The system of claim 7 wherein the BHA further comprises a pressure-temperature-casing collar locator module.

13. A method for accessing a wellbore in a multilateral system, comprising:

providing a coiled tubing and a control center at a wellsite surface;

conveying the coiled tubing and a bottom hole assembly (BHA) from the wellsite surface into the wellbore to a target depth, the BHA comprising an electrical circulation sub (ECS) operable to allow fluid flow through the coiled tubing and through the BHA, to divert fluid flow from the coiled tubing out the BHA into the wellbore, or both;

a tractor for conveying the BHA and the coiled tubing through the wellbore; and a bent sub configured to be rotated with respect to an axis of the BHA;

sending control signals from the control center to configure the ECS to permit the fluid to pass through the BHA to the tractor when conveying, the ECS operable to provide adjustable flow through the BHA to the tractor;

upon reaching a target depth, sending control signals from the control center to configure the ECS to divert the fluid from the ECS and into the wellbore;

performing a wellbore operation with the fluid, thereby controlling the flow of the fluid through the BHA to instances when use of the tractor is needed to achieve the target well depth; and sending a signal from the control center to rotate the bent sub during the wellbore operation without the need to have the fluid pumped therethrough.

14. The method of claim 13 further comprising determining a status and position of the BHA for a well intervention treatment.

15. The method of claim 14 wherein performing comprises performing a profiling operation.

16. The method of claim 13, wherein performing comprises performing a stimulation treatment.

17. The method of claim 16, wherein performing comprises performing an acidizing treatment.

* * * * *